United States Patent [19]

Satoh et al.

[11] Patent Number: 4,819,855

[45] Date of Patent: Apr. 11, 1989

[54] TAG-PIN ATTACHING APPARATUS

[75] Inventors: Akira Satoh; Shin-ichi Sato, both of Tokyo, Japan

[73] Assignee: Satoh Gosei Co., Ltd., Tokyo, Japan

[21] Appl. No.: 190,643

[22] Filed: May 4, 1988

[30] Foreign Application Priority Data

May 11, 1987 [JP] Japan ..... 62-113943

[51] Int. Cl.[4] ..... B25C 1/00

[52] U.S. Cl. ..... 227/67; 227/109

[58] Field of Search ..... 227/67, 109

[56] References Cited

U.S. PATENT DOCUMENTS

| | | | |
|---|---|---|---|
| 3,103,666 | 9/1963 | Bone . | |
| 4,310,962 | 1/1982 | Suzuki et al. | 227/67 X |
| 4,402,446 | 9/1983 | Suzuki | 227/67 |
| 4,461,417 | 6/1984 | Furutsu | 227/67 |
| 4,465,218 | 8/1984 | Furutsu | 227/67 |
| 4,482,087 | 11/1984 | Furutsu | 227/67 |
| 4,485,954 | 12/1984 | Furutsu | 227/67 |
| 4,651,913 | 3/1987 | Bone | 227/67 |

*Primary Examiner*—Frank T. Yost
*Assistant Examiner*—James L. Wolfe
*Attorney, Agent, or Firm*—Oblon, Fisher, Spivak, McClelland & Maier

[57] ABSTRACT

A tag-pin attaching apparatus is disclosed, which comprises (a) a tag-pin feeding mechanism for intermittently feeding a leading tag pin of a tag-pin assembly to a cut-off position, which tag-pin assembly consists of a plurality of tag pins, each tag pin comprising a head part and a lateral rod which are integrally connected through a filament, and each tag pin being separable from the tag-pin assembly at the cut-off position, (b) a guide needle situated in front of the cut-off position, (c) a guide groove for guiding the lateral rod of the tag-pin assembly in the feeding direction thereof, (d) a transporting mechanism, situated behind the tag-pin feeding mechanism, for pushing the tag pin positioned at the cut-off position into the guide needle, and (e) a driving mechanism for driving each of the above mechanisms, with the improvement wherein the feeding mechanism comprises (i) a slide body which is movably disposed in the feeding direction of the tag pin, (ii) a toggle link comprising a first link and a second link, an external edge portion of one of the two links being rotatably supported by the side body, (iii) a slide link for rotatably supporting an external edge portion of the other link, which slide link is disposed in such a manner as to be movable within the slide body, (iv) a pawl portion which extends from the first link of the toggle link, (v) a stopper for regulating the extension of the toggle link, and (vi) a brake mechanism.

1 Claim, 19 Drawing Sheets

FIG. 13
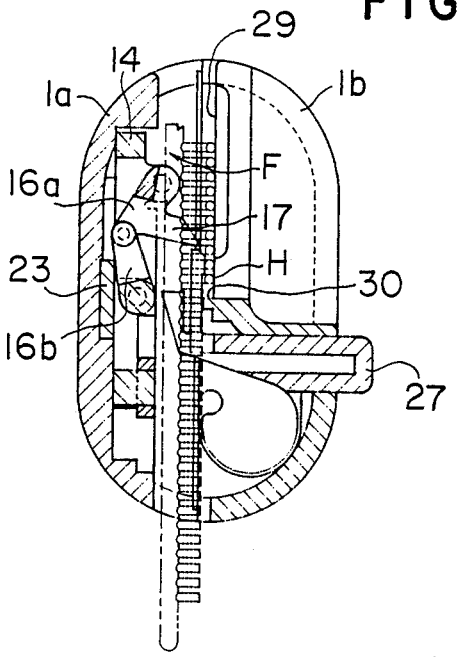
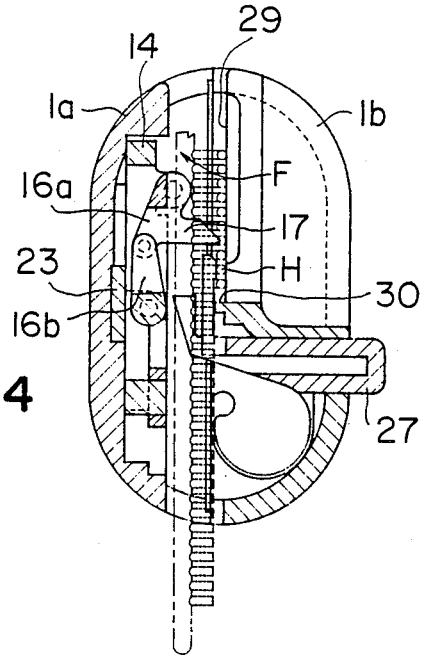
FIG. 14

FIG. 15
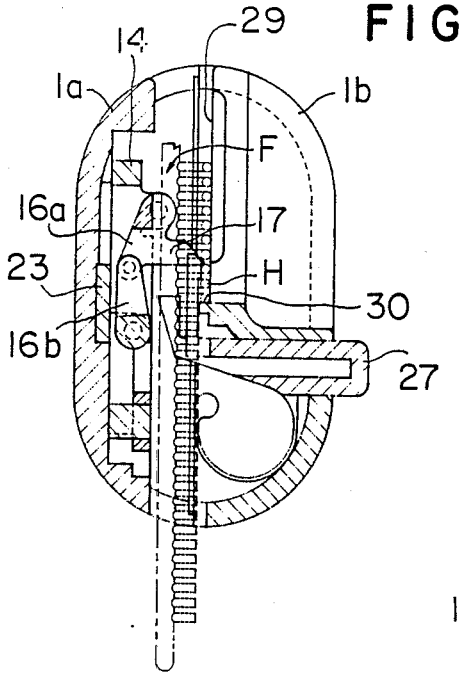
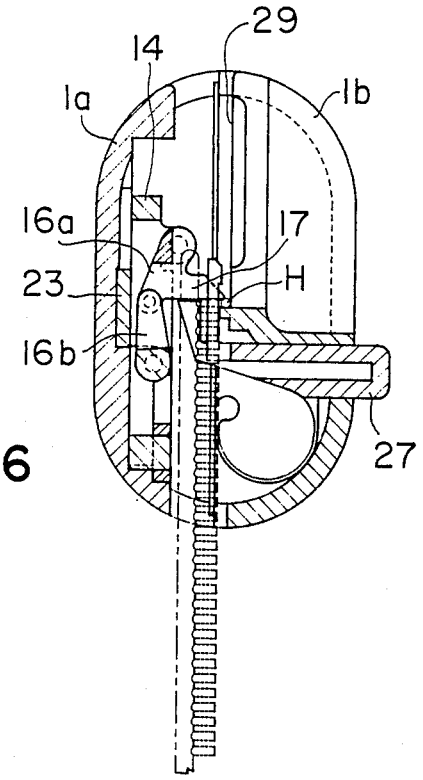
FIG. 16

TAG-PIN ATTACHING APPARATUS

BACKGROUND OF THE INVENTION

The present invention relates to a tag-pin attaching apparatus for attaching labels such as price tags to clothes and other fabric materials.

Conventionally various types of tag-pin attaching apparatus are known, for instance, under the names of locking piece fitter and device for attaching connecting pieces, as disclosed, for instance, in U.S. Pat. Nos. 3,103,666, 4,310,962 and 4,402,446.

Generally a tag pin for use in the tag-pin attaching apparatus is made of plastics material and comprises a head part and a lateral rod which are integrally connected through a connecting filament. A number of the tag pins are integrally, but separably connected to form a tag-pin assembly.

The tag pins and tag-pin assemblies for use in the present invention may be the same as those employed conventionally, for instance, as those disclosed in the above-mentioned U.S. Patents. When the tag pins are attached to commercial products such as clothes, some products do not need any particular care, but other products must be handled with the utmost care so as not to be scratched by the tag pins. Depending upon the kind of the products for which tag pins are used, two types of tag pins are currently available. One type has a lateral rod having a diameter of about 1 mm, and the other has a lateral rod having a diameter of about 0.8 mm. In the future, tag pins having lateral rods with a smaller diameter will be used.

In accordance with the above-mentioned different diameters of the lateral rods, there are two types of tag-pin attaching apparatus for each diameter of the lateral rod.

In the tag-pin attaching apparatus, the position of a leading tag pin of a tag pin assembly is registered, and the leading tag pin is pushed into a hole formed in a guide needle (which hole is C-shaped in the cross section thereof) by a push-in rod, which has substantially the same diameter as that of the lateral rod, as the tag pin is cut at its connecting part off the tag-pin assembly. Therefore it is necessary that the hole of the guide needle and the push-in rod be concentrically positioned.

However, in a guide groove, a clearance of about 10 to 30% relative to the diameter of the lateral rod is necessary for smoothly guiding the tag-pin assembly therethrough. When there is such a clearance in the guide groove, the lateral rods are apt to move in the directions of the arrows as shown in FIG. 18, so that it is difficult to register the position of the lateral rod at its cutting position. Therefore, conventionally it is inevitable to use a tag-pin attaching apparatus which is exclusively designed for a particular diameter of the lateral rod.

SUMMARY OF THE INVENTION

It is therefore an object of the present invention to provide a tag-pin attaching apparatus which is capable of allowing the use of tag pins with lateral rods having different diameters.

This object of the present invention can be achieved by a tag-pin attaching apparatus comprising: (a) a tag-pin feeding mechanism for intermittently feeding a leading tag pin of a tag-pin assembly to a cut-off position, which tag-pin assembly consists of a plurality of tag pins, each tag pin comprising a head part and a lateral rod which are integrally connected through a filament, and each tag pin being separable from the tag-pin assembly at the cut-off position, (b) a guide needle situated in front of the cut-off position, (c) a guide groove for guiding the lateral rod of the tag-pin assembly in the feeding direction thereof, (d) a transporting mechanism, situated behind the tag-pin feeding mechanism, for pushing the tag pin positioned at the cut-off position into the guide needle, and (e) a driving mechanism for driving each of the above mechanisms, with the improvement wherein the feeding mechanism comprises (i) a slide body which is movably disposed in the feeding direction of the tag pin, (ii) a toggle link comprising a first link and a second link, an external edge portion of one of the first and second links being rotatably supported by the side body, (iii) a slide link for rotatably supporting an external edge portion of the other link, which slide link is disposed in such a manner as to be movable within the slide body, (iv) a pawl portion which extends from the first link of the toggle link, situated in such a manner that the tip of the pawl portion partly comes out from between the lateral rods of the tag-pin assembly as said toggle link extends, (v) a stopper for regulating the extension of the toggle consisting of the first and second links at a position where the toggle link bends in such a direction as to move away from the lateral rod of the tag-pin assembly, with the fulcrum of the toggle link slightly going beyond the change point thereof, and (vi) a brake mechanism for braking the slide body, with the slide link being connected with the driving mechanism.

BRIEF DESCRIPTION OF THE DRAWINGS

In the drawings,

FIGS. 11 to 16 are the diagrams in explanation of the operation of the feeding mechanism of the tag-pin attaching apparatus according to the present invention.

DETAILED DESCRIPTION OF THE PREFERRED EMBODIMENT

With reference to the accompanying drawings, an embodiment of a tag-pin attaching apparatus according to the resent invention will now be explained.

Figure 1:
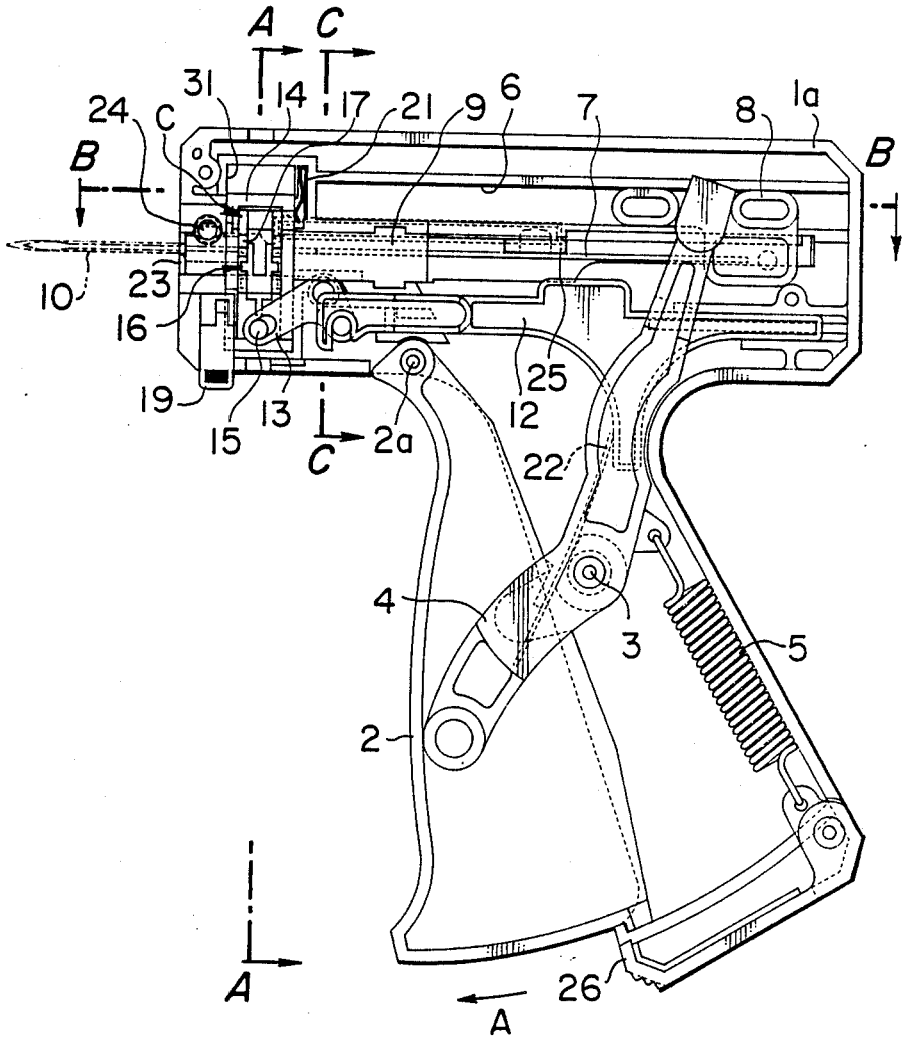
FIG. 1 is an upper-case-removed side view of an example of a tag-pin attaching apparatus according to the present invention.
Figure 2:
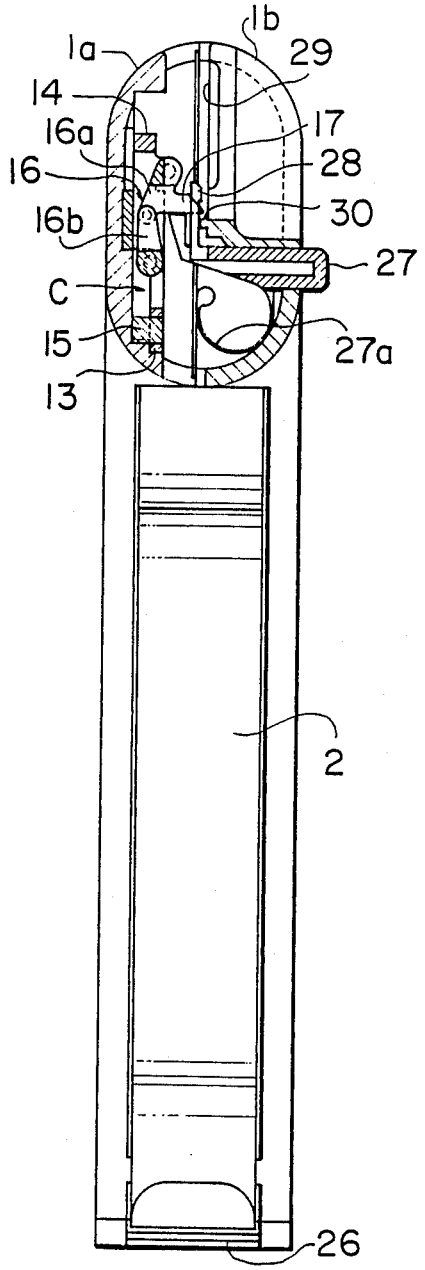
FIG. 2 is a cross-sectional view taken on line A—A in FIG. 1.
Figure 3:
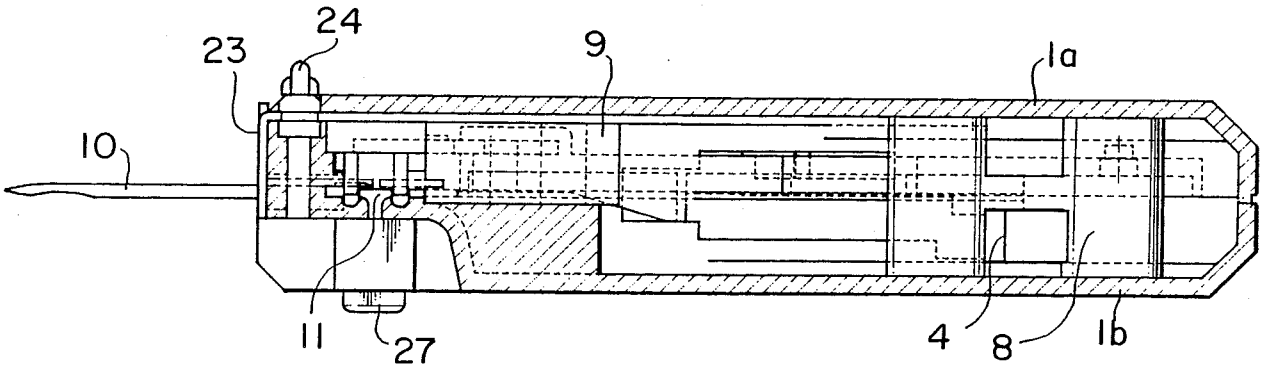
FIG. 3 is a cross-sectional view taken on line B—B in FIG. 1.
Figure 5:
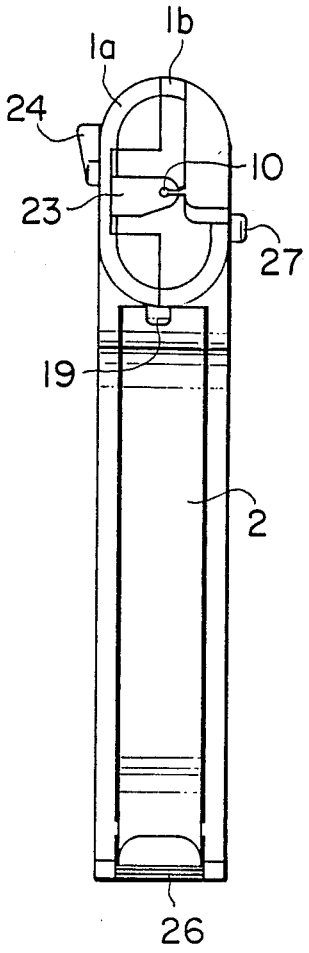
FIG. 5 is an overall front view of the tag-pin attaching apparatus shown in FIG. 1.
Figure 4:
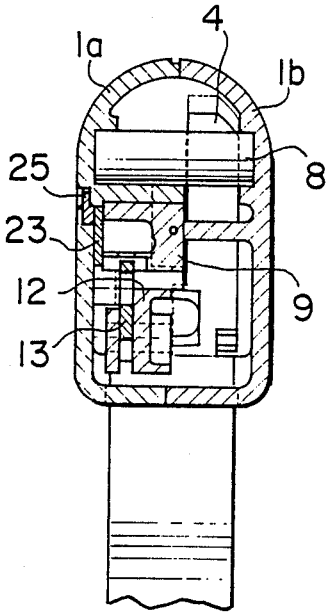
FIG. 4 is a cross-sectional view taken on line C—C in FIG. 1.

The tag-pin attaching apparatus is in the shape of a pistol as shown in FIG. 1 and comprises two portions, a portion covered by an under case 1*a* and a portion covered by an upper case 1*b*, when viewed from the thickness direction thereof, as shown in FIG. 3. After each mechanism is assembled within the under case 1*a* as shown in FIGS. 20 through 28, the upper case 1*b* is attached so as to fix the under case 1*a*.

At the front side of a gripping portion of this tag-pin attaching apparatus, there is provided a grip 2 which rotates around a fulcrum 2*a* of the tag-pin apparatus. The grip 2 is always urged in the direction of the arrow A in FIG. 1, because a drive arm 4 which is movable around a fulcrum 3 is maintained in a position as shown in FIG. 1 by a grip spring 5.

In the upper portion of the under case 1*a*, a guide groove 6 is formed in the horizontal direction. In the guide groove 6, a slider 8 with a push bar 7 secured to the top thereof is slidably fitted. The tip portion of the drive arm 4 is loosely fitted into the slider 8, so that the slider 8 is slidably moved within the guide groove 6 by the drive arm 4 in accordance with the operation of the grip 2. Further, the tip portion of the push bar 7 is slidably guided within a bar holder 9.

Figure 6:
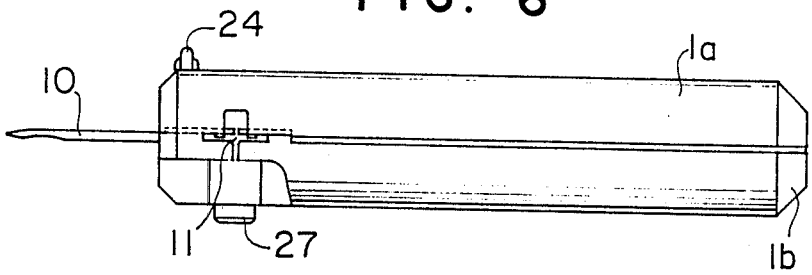
FIG. 6 is an overall plan view of the tag-pin attaching apparatus according to the present invention.
Figure 7:
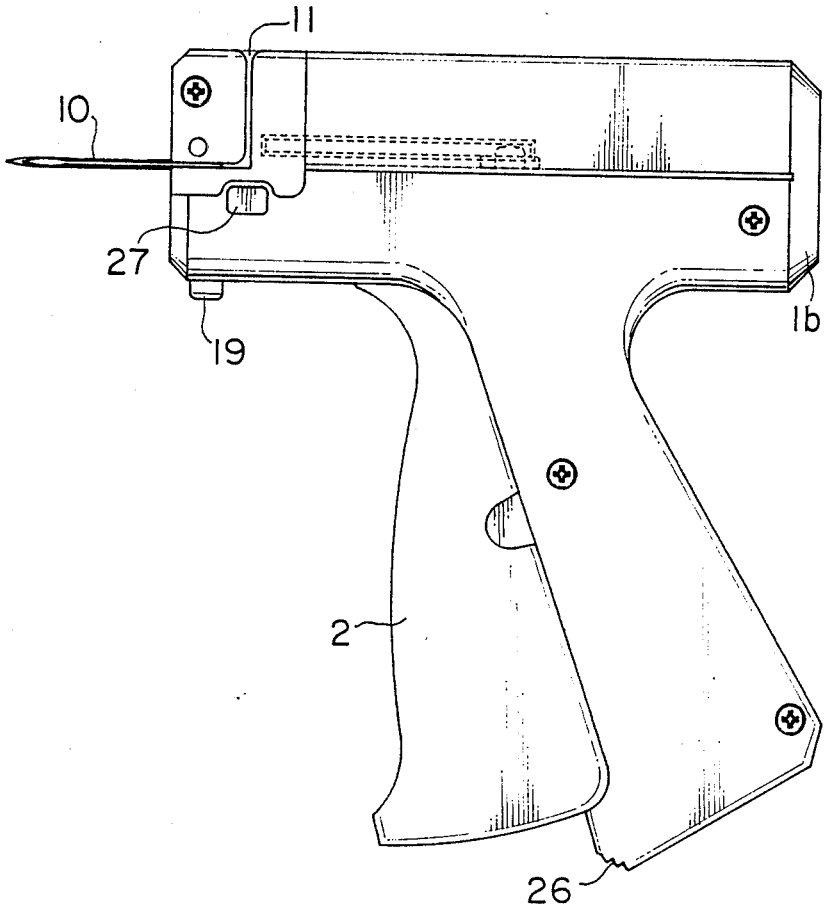
FIG. 7 is a side view of the tag-pin attaching apparatus according to the present invention.

As can be seen from FIG. 3, the top portion of the upper case 1*b* existing on the extended axis of the push bar 7 is detachably provided with a guide needle 10, and a tag-pin assembly F is fitted between the guide needle 10 and the push bar 7 in such a manner as to be positioned substantially orthogonally with the axis of the guide needle 10, and a T-shaped guide groove 11 for guiding a lateral rod H of the tag-pin assembly F in the feeding direction thereof is formed in the upper case 1*b* as shown in FIGS. 6 and 7.

A feeding mechanism C is provided in the guide groove 11 inside the under case 1*a*. The feeding mechanism C is constructed as follows. Near the forward movement limit and the backward movement limit of the slider 8, a connecting bar 12 is moved by the drive arm 4, so that the feeding mechanism C is moved in the direction orthogonal to the guide needle 10 through a bell crank 13 which is connected to the connecting bar 12.

More specifically, the bell crank 13 is connected to a lower portion of a slide link 15 which is slidably disposed within a slide body 14, which is in the shape of a reversed U in the front view. An end portion of a second link 16*b* of a toggle link 16 is rotatably supported on the upper portion of the slide link 15. On the link 16*b*, there is rotatably supported the rear portion of a first link 16*a* provided with a pawl 17. Further, the top portion of the first link 16*a* is rotatably supported by the slide body 14.

Figure 8:
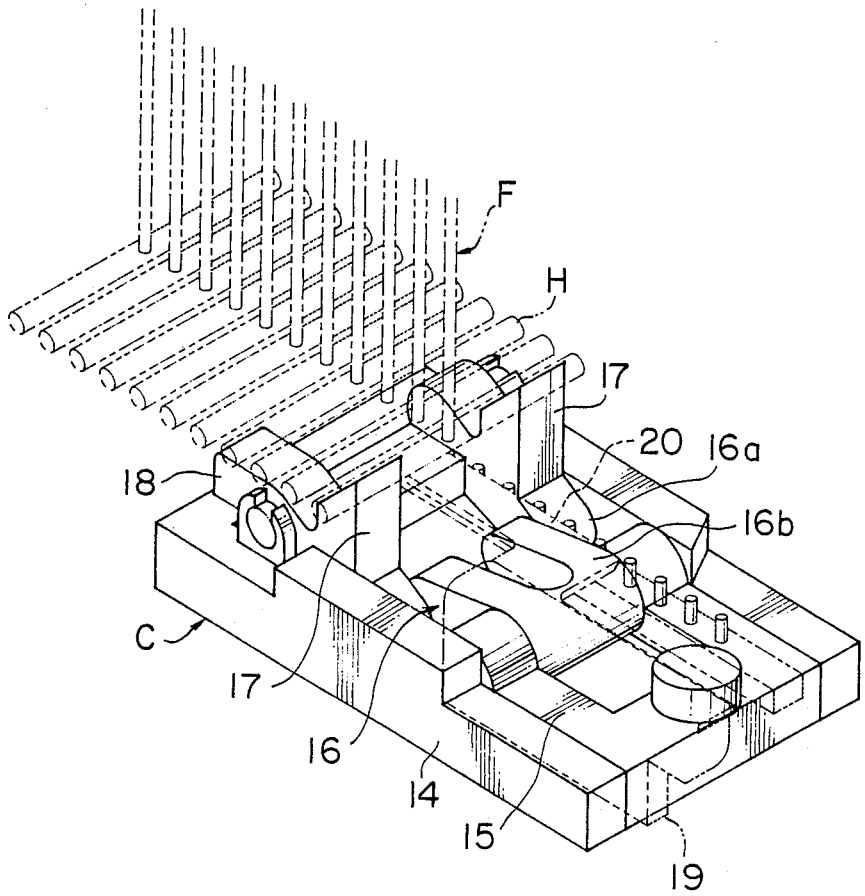
FIG. 8 is a perspective view of a feeding mechanism in explanation thereof.
Figure 9:
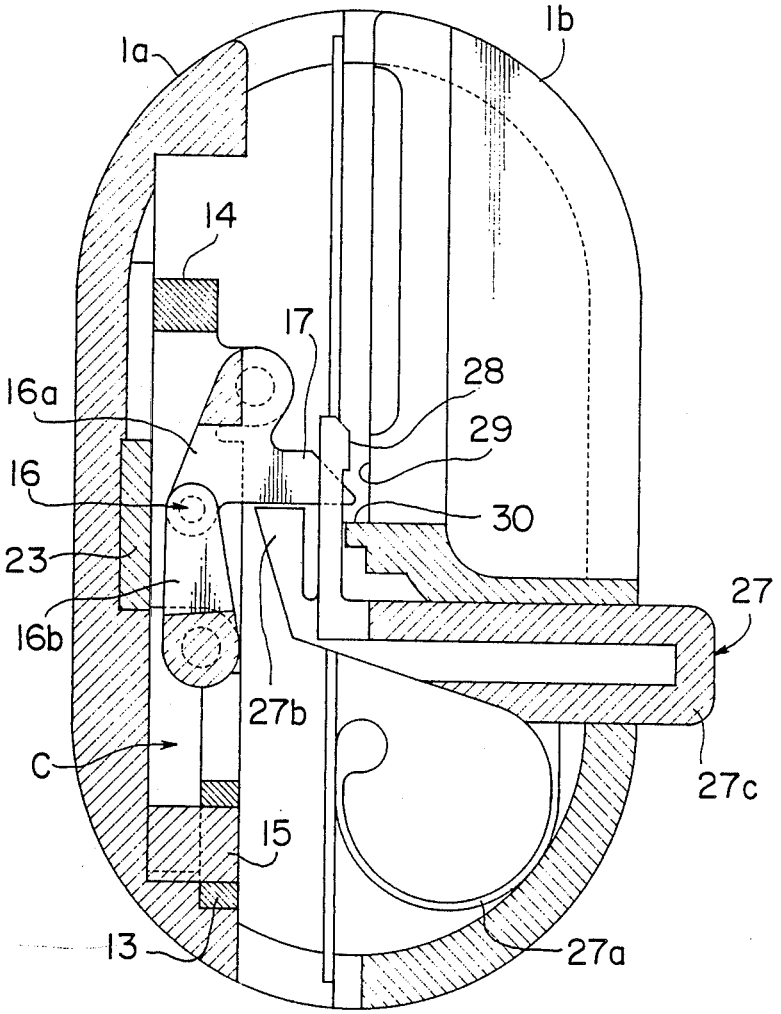
FIG. 9 is a cross-sectional view the feeding mechanism and the adjacent portion of the tag-pin attaching apparatus according to the present invention.

As a whole, the toggle link 16 is bent in such a direction as to be positioned away from the lateral rods H of the tag-pin assembly F as may be seen from FIG. 8 and FIG. 9. The bent state of the toggle link 16 is controlled with respect to its maximum length by a stopper 18 in such a manner that the elongation thereof becomes maximum at a position where the supporting point of the links 16*a* and 16*b* does not go beyond the change point thereof. The previously mentioned pawl 17 is disposed in such a manner that when the toggle link 16 is elongated, the tip of the pawl 17 comes between the lateral rods H of the tag-pin assembly F, while when the toggle link 16 is shrunk, the top portion of the pawl 17 is moved away from between the lateral rods H of the tag-pin assembly F.

A brake spring 21 is provided adjacent to the slide body 14. The brake spring 21 is designed so as to brake the slide body 14 with force which is slightly larger than the force necessary for moving each link of the toggle link 16 and the slide link.

The thus constructed feeding mechanism C serves to feed and place the tag-pin assembly F at a predetermined position.

In the guide groove 11, there is provided a cutter 20 supported by a cutter knob 19, which cuts the connecting portion of the tag-pin assembly F.

Figure 19:
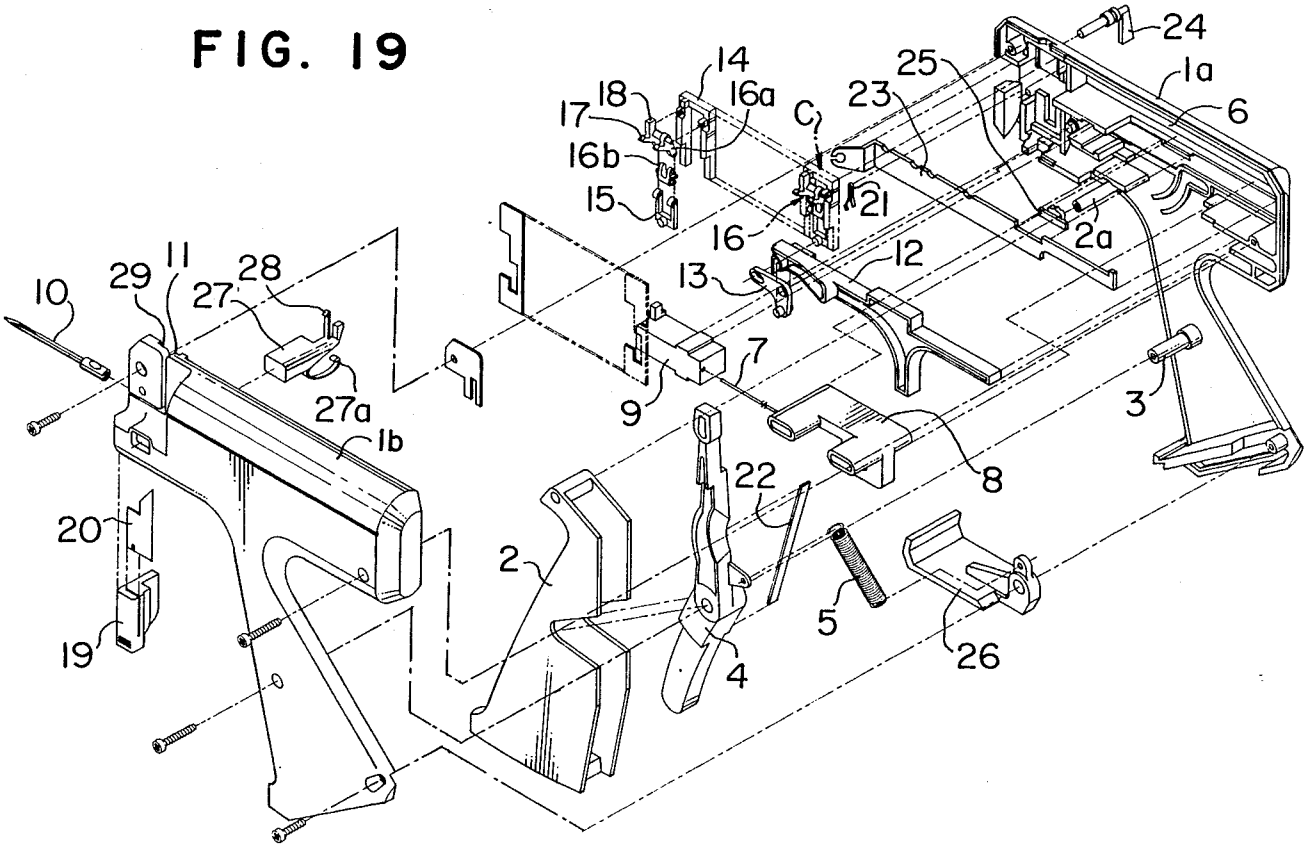
FIG. 19 is an exploded view of the tag-pin attaching apparatus according to the present invention.
Figure 20:
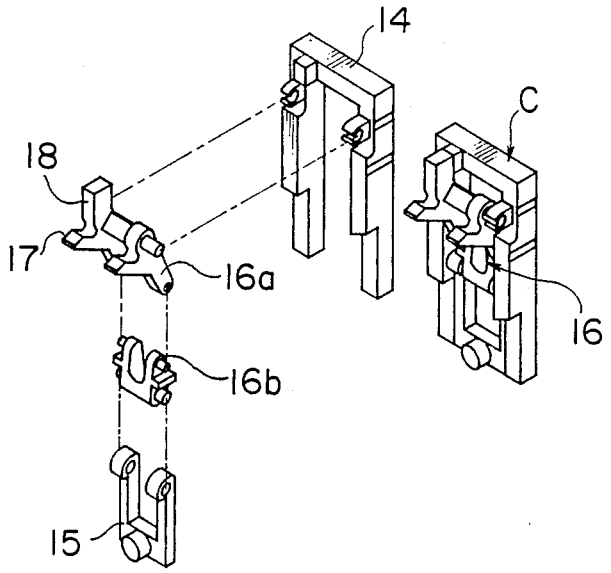
FIGS. 20 through 28 are the diagrams in explanation of the assembling of the tag-pin attaching apparatus according to the present invention.
Figure 21:
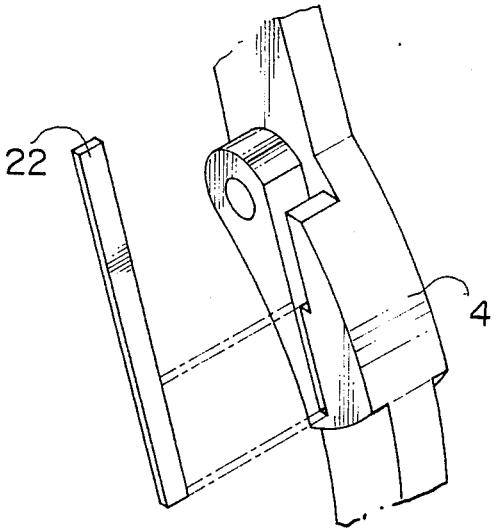
Figure 22:
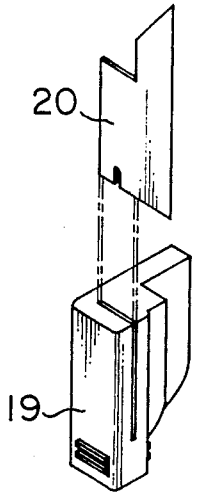
Figure 27:
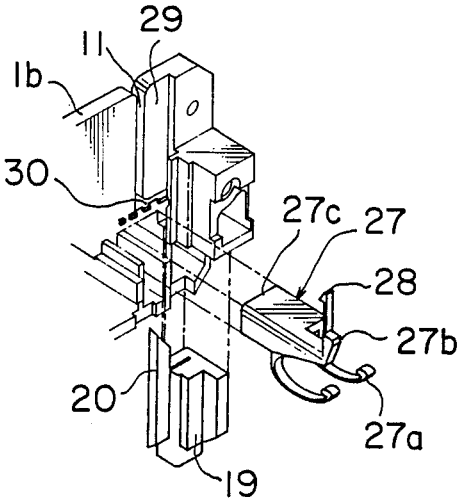
Figure 23:
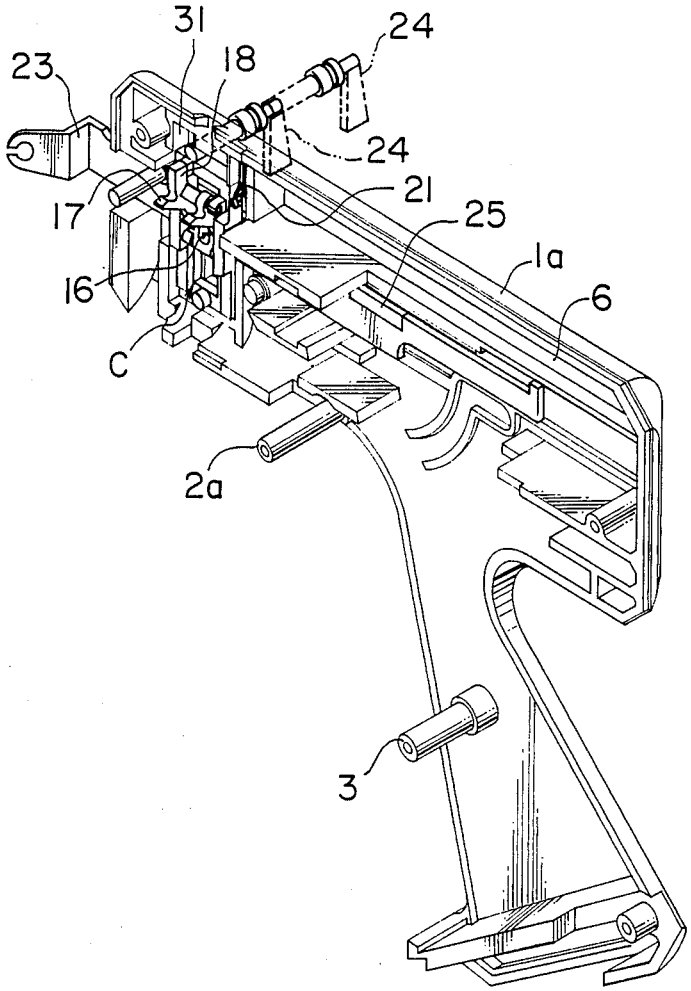
Figure 24:
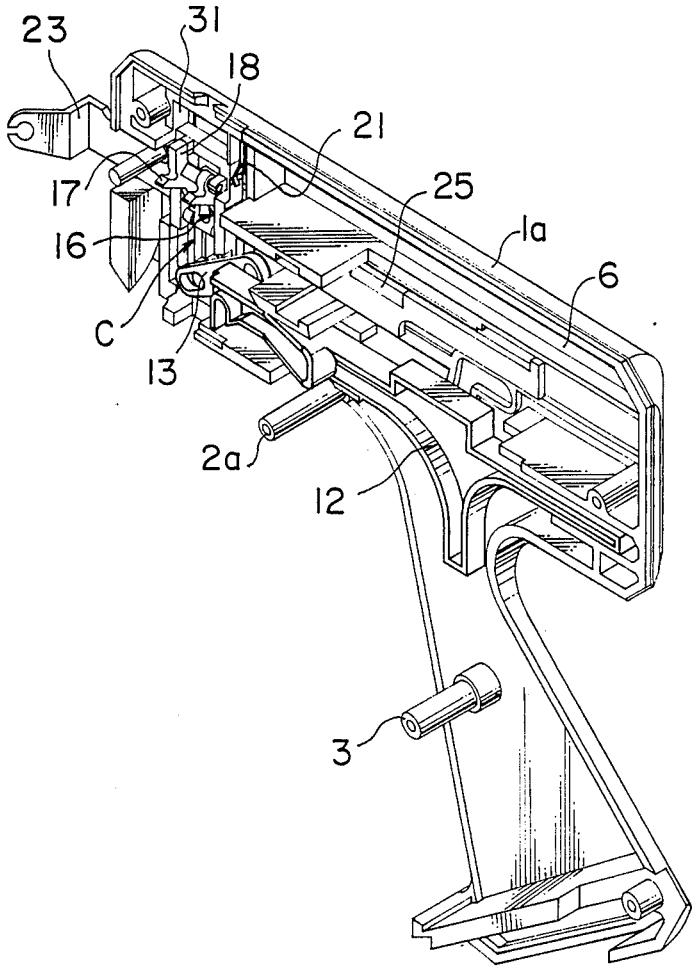
Figure 25:
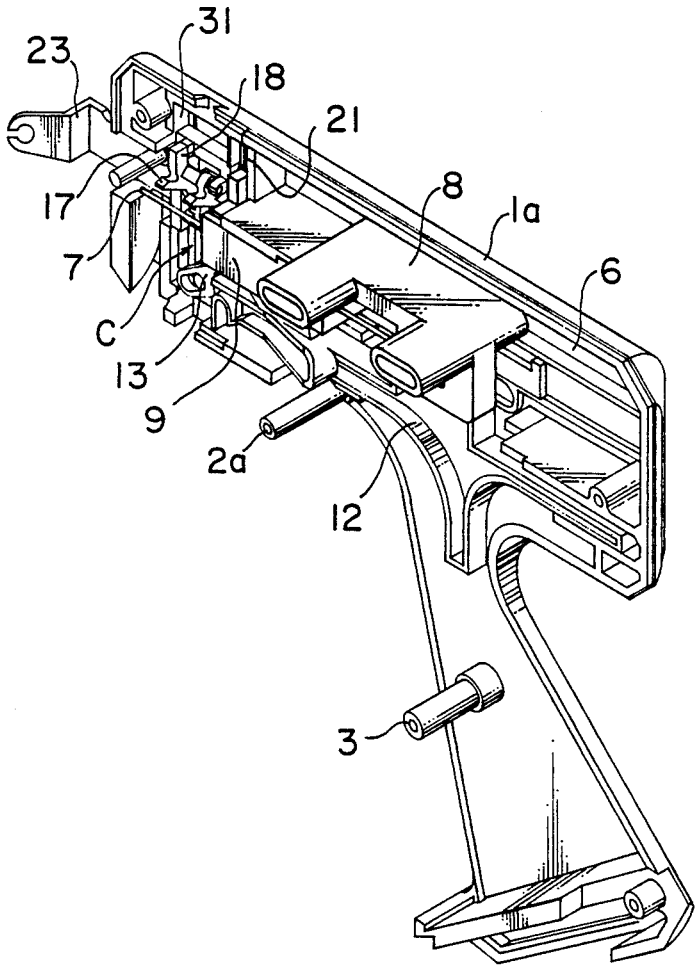
Figure 26:
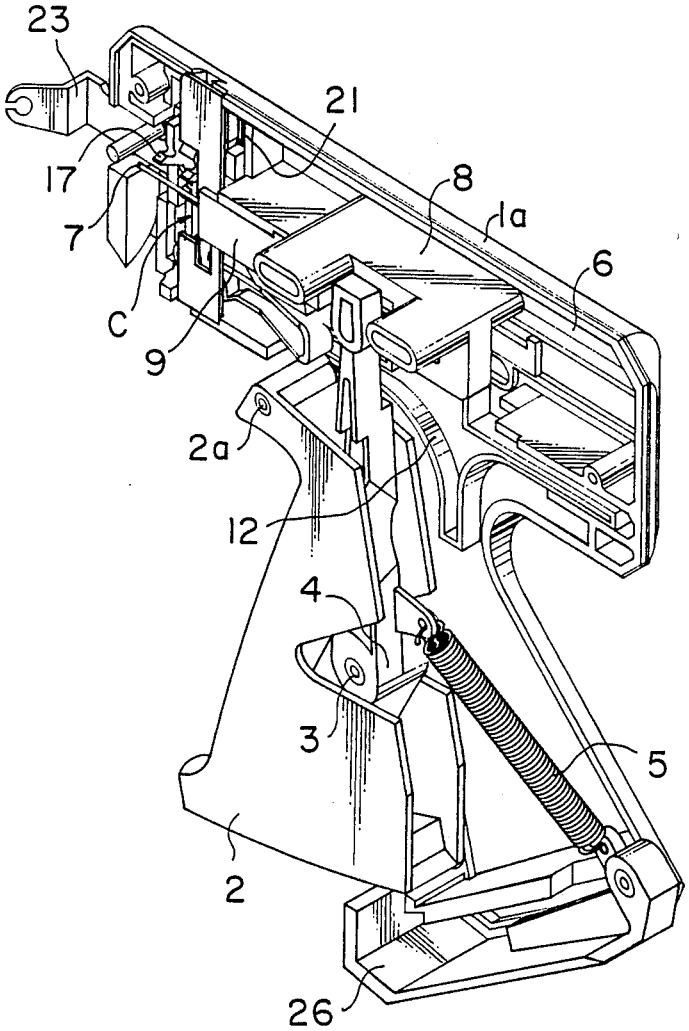
Figure 28:
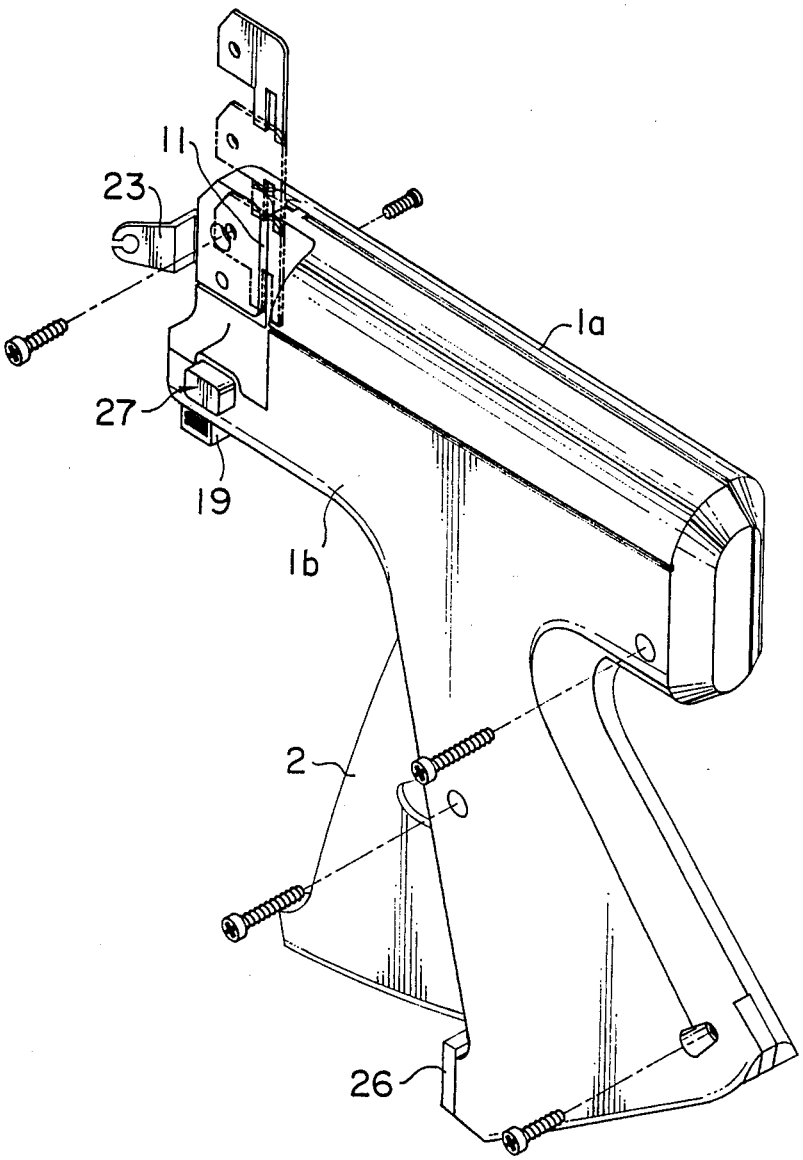

In FIG. 1 and FIG. 19, reference numeral 22 indicates a plate spring, with the lower end thereof being connected to the drive arm 4 in the shape of a cantilever, which plate spring 22 serves to return the connecting bar 12 by the top portion thereof. Since the feeding amount by the feeding mechanism C differs depending upon the pitch of the tag-pin assembly F, the plate spring 22 absorbs the difference in the amount of momentum between a certain constant momentum of the drive arm 4 and a variable momentum of the connecting bar 12.

Reference numeral 23 indicates a depth gauge attached to the tip of the under case 1*a*, by which the inserting depth of the guide needle 10 is adjusted. The position of the depth of the guide needle 10 selected and determined by the depth gauge 23 is adjusted and fixed by a key 24. The key 24 has also the function of fixing the guide needle 10. Reference numeral 25 indicates a slide knob for sliding the depth gauge 23. Reference numeral 26 indicates a pocket cover which is urged in a closing direction by the grip spring 5.

Reference numeral 27 indicates a free button 27, which is positioned within the guide groove 11, with a hook 28 being formed in a contact portion with the lateral rods H, and serves to prevent the tag-pin assembly F from moving in an opposite direction by the action of a spring 27*a*, and to urge auxiliarily the lateral rods H of the tag-pin assembly F to a ceiling wall 29 of the guide groove 11.

The free button 27 is provided with a tongue member 27*b* which extends from the free bottom 27. The tongue member 27*b* is disposed in a position where a portion near the supporting point of the link 16*a* on the link 16*b* is depressed when a button portion 27*c* extending from the upper case 1*b* is depressed. Thus, when the tag-pin assembly F is pulled out from the guide groove 11, the toggle link 16 is bent in such a direction as to be moved away from the lateral rods H by depressing the button portion 27*c*. Thus, the pawl 17 is detached from the lateral rods H, so that the tag-pin assembly F can be easily pulled out.

The operation of the tag-pin attaching apparatus according to the present invention will now be explained.

When the guide needle 10 is thrust in a cloth or texture and the grip 2 is gripped, the slider 8 is moved to the left by the drive arm 4, and the push bar 7 is moved forward in the guide groove 11 so as to come into contact with the end of the lateral rod H supported by the pawl 17, then the connecting portion of the tag-pin assembly F is cut by the cutter 20, and the push bar 7 pushes the lateral rod H of the tag-pin assembly F into the guide needle 10, whereby the tag pin is attached to the cloth.

Figure 10:
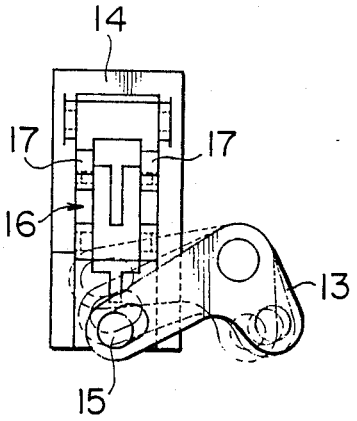
FIG. 10 is a front view of the feeding mechanism and the portion thereof of the tag-pin attaching apparatus according to the present invention.
Figure 11:
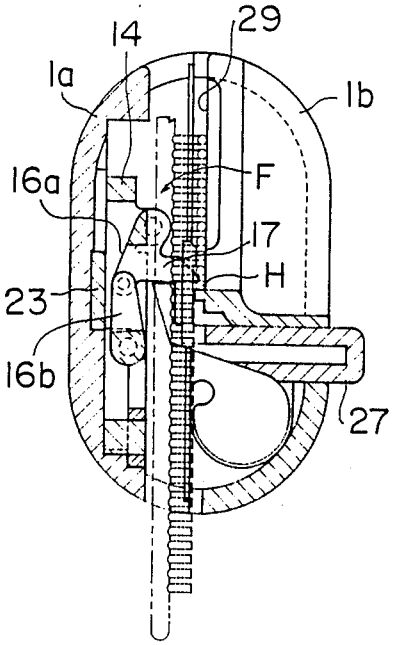

The above operation will now be explained in more detail. The lowermost lateral rod H of the tag-pin assembly F in the state as shown in FIG. 11 is thrust in the cloth. At this final thrusting step, the connecting bar 12 is moved to the left in FIG. 1, near the forward movement limit of the drive arm 4. By this movement of the connecting bar 12, the bell crank 13 tends to be rotated clockwise in FIG. 10, and accordingly the slide body 14 is caused to tend to move upward. However, since the slide body 14 is caused to come into light pressure contact with its passage wall 31 (part of the under case 1*a*) by the snapping force of the brake spring 21, the toggle link 16 is bent through the slide link 15 in such a direction as to be moved away from the tag-pin assembly F, in which direction the operation resistance becomes minimum.

Figure 12:
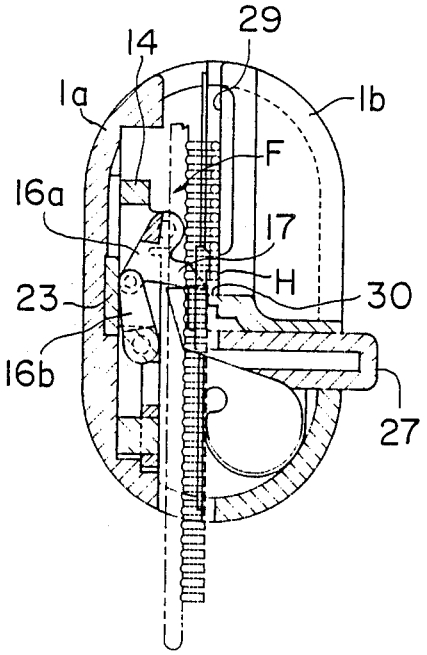

By the above operation, the pawl 17 is moved away from the lateral rod. Since the portion near the supporting point of the toggle link 16 comes into contact with the bottom of the above-mentioned passage (the bottom of the under case), the toggle link 16 is not bent any further as shown in FIG. 12. It remains stopped at a side of a line connecting positions of support of the first and second links opposite the lateral rod of the tag-pin assembly.

Further, when the slide link 15 is pushed upward by the bell crank 13, the slide body 14 is moved upward against the resistance of the brake spring 21 through the toggle link 16 as shown in FIG. 13. The position of the thus moved slide body 14 corresponds to the forward movement limit.

When the grip 2 is released, the drive arm 4 is moved backward by the grip spring 5. When the drive arm 4 reaches a position near the backward movement limit thereof, the connecting bar 12 is moved to the right by the action of the plate spring 22 attached to the drive arm 4, and the bell crank 13 is rotated counterclockwise. In accordance with this, the slide link 15 also tends to move downward. However, at this moment, the slide body 14 is braked by the brake spring 21, so that the bent toggle link 16 is first elongated, and then the pawl 17 comes between the lateral rods H as shown in FIG. 14.

Subsequently the lateral rod H of the tag-pin assembly is pushed toward the ceiling wall 29 of the guide groove 11 and then comes into contact with the ceiling wall 29.

In this state, the stopper 18 of the link 16*a* is caused to come into contact with the slide body 14 in order that the pawl 17 not come between the lateral rods H any further as shown in FIG. 8.

Figure 17:
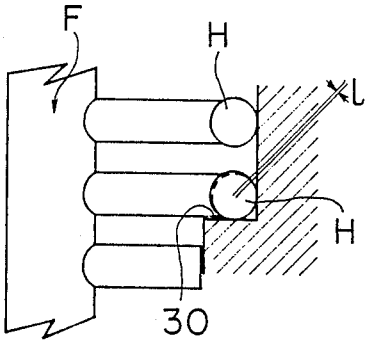
FIG. 17 is a diagram in explanation of the registration of the position of a lateral rod.

Therefore, by the downward moving force of the slide link 15, the pawl 17 is moved downward through the toggle link 16. By this action, the tag-pin is moved to a thrusting position, where the position of the lateral rod H of the tag-pin is registered in the two directions by the ceiling wall 29 of the feeding groove 11 and by the position registrating surface 30 of the thrusting position as shown in FIG. 15 and FIG. 17.

Figure 18:
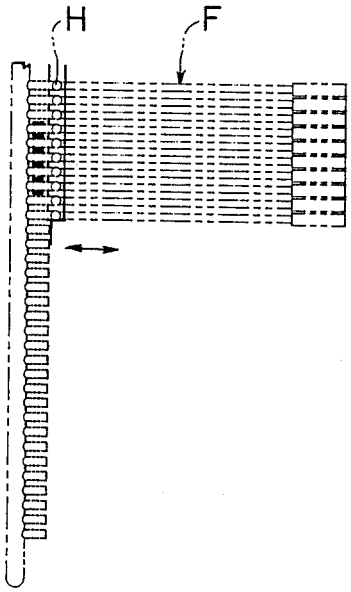
FIG. 18 is a diagram in explanation of a conventional tag-pin attaching apparatus.

In a conventional tag-pin attaching apparatus, the tag-pin assembly F is moved relatively easily in the directions of the arrows in FIG. 18, so that the registration of the lateral rod at the thrusting position is difficult.

In contrast to this, in the present invention, even when the diameters of the lateral rods H are, for example, 0.8 mm and 1 mm, the shifting range l of the lateral rods can be minimized to about 0.1 mm. Therefore, even when the diameter of the lateral rod H varies more or less, the lateral rods H ca be securely guided into the guide needle 10. Furthermore, since the pawl 17 of the feeding mechanism C is moved upward, away from between the lateral rods, it does not occur that the tag-pin assembly F is moved in the opposite direction as the feeding mechanism C is moved upward.

Furthermore, as shown in FIG. 16, even when only one tag pin is left in the tag-pin assembly, it can be tightly held by the pawl 17 so that the tag-pin assembly can be used to the last tag pin.

What is claimed is:

1. In a tag-pin attaching apparatus comprising:

(a) a tag-pin feeding mechanism for intermittently feeding a leading tag pin of a tag-pin assembly to a cut-off position, which tag-pin assembly consists of a plurality of tag pins, each tag pin comprising a head part and a lateral rod which are integrally connected through a filament, and each tag pin being separable from said tag-pin assembly at said cut-off position, (b) a guide needle situated in front of said cut-off position, (c) a guide groove for guiding the lateral rod of said tag-pin assembly in the feeding direction thereof, (d) a transporting mechanism, situated behind said tag-pin feeding mechanism, for pushing the tag pin positioned at the cut-off position into the guide needle, and (e) a driving mechanism for driving each of said mechanisms, the improvement wherein said feeding mechanism comprises:

a slide body which is movably disposed in the feeding direction of said tag pin, a toggle link comprising a first link and a second link, an external edge portion of one of said first and second links being rotatably supported by said slide body, a slide link for rotatably supporting an external edge portion of the other link, said slide link being disposed in such a manner as to be movable within said slide body, a pawl portion which extends from said first link of the toggle link, situated in such a manner that the tip of said pawl portion partly comes out from between the lateral rods of said tag-pin assembly as said toggle link extends, a stopper for regulating the extension of said toggle link consisting of the first and second links at a position where said toggle link bends in such a direction as to move away from the lateral rod of said tag-pin assembly, with the fulcrum of said toggle link being positioned on a side of a line connecting positions of support of said first and second links opposite said lateral rod of said tag-pin assembly, and a brake mechanism for braking the slide body, with said slide link being connected with said driving mechanism.

* * * * *